US012351358B2

(12) United States Patent
Liming et al.

(10) Patent No.: US 12,351,358 B2
(45) **Date of Patent: *Jul. 8, 2025**

(54) CONTAINER HAVING A STACKING FEATURE

(71) Applicant: Huhtamaki, Inc., De Soto, KS (US)

(72) Inventors: Michael Liming, New Vienna, OH (US); Don Tomalia, Midland, MI (US)

(73) Assignee: HUHTAMAKI, INC., De Soto, KS (US)

( * ) Notice: Subject to any disclaimer, the term of this patent is extended or adjusted under 35 U.S.C. 154(b) by 95 days.

This patent is subject to a terminal disclaimer.

(21) Appl. No.: 17/953,931

(22) Filed: Sep. 27, 2022

(65) Prior Publication Data

US 2023/0012901 A1 Jan. 19, 2023

Related U.S. Application Data

(60) Continuation-in-part of application No. 17/508,825, filed on Oct. 22, 2021, now Pat. No. 11,794,940, (Continued)

(51) Int. Cl.
*B65D 21/02* (2006.01)
*A45F 3/20* (2006.01)
(Continued)

(52) U.S. Cl.
CPC ..... *B65D 1/44* (2013.01); *A45F 3/20* (2013.01); *A47G 19/03* (2013.01); *A47G 19/23* (2013.01);
(Continued)

(58) Field of Classification Search
CPC ..... A45F 3/20; A47G 19/23; B65D 21/0233; B65D 21/0234; B65D 21/043; B65D 21/04; B65D 21/048; B65D 88/025
(Continued)

(56) References Cited

U.S. PATENT DOCUMENTS 2,218,388 A 10/1940 Twombly
D144,300 S 4/1946 Nicholson
(Continued)

FOREIGN PATENT DOCUMENTS

CA 2581275 A1 4/2006
CA 2597017 A1 9/2006
(Continued)

*Primary Examiner* — Allan D Stevens
(74) *Attorney, Agent, or Firm* — Husch Blackwell LLP

(57) ABSTRACT

A container having enhanced wall integrity with a rotational element and a stacking feature is provided. The container includes a sidewall having an alignment structure formed along a height of the sidewall and an upper stacking shoulder formed above the alignment structure. The alignment structure is adapted for orienting the container with respect to a second container so that the alignment structures of the containers become parallel with one another and the containers may be fully nested one within the other. The alignment structure can be recessed into the sidewall to form peaks and valleys along an inner surface of the container. The upper stacking feature is formed into the sidewall of the container and includes a radially extending wall portion and an upwardly extending wall portion that together form a stacking corner. The stacking shoulder is provided above the alignment structure facilitates nesting of two containers when stacked together.

18 Claims, 10 Drawing Sheets

Related U.S. Application Data which is a division of application No. 15/090,280, filed on Apr. 4, 2016, now Pat. No. 11,167,874, which is a continuation of application No. 13/162,307, filed on Jun. 16, 2011, now Pat. No. 9,314,089.

(60) Provisional application No. 63/248,929, filed on Sep. 27, 2021.

(51) Int. Cl.

| | |
|---|---|
| ***A47G 19/03*** | (2006.01) |
| ***A47G 19/23*** | (2006.01) |
| ***B65D 1/00*** | (2006.01) |
| ***B65D 1/26*** | (2006.01) |
| ***B65D 1/42*** | (2006.01) |
| ***B65D 1/44*** | (2006.01) |

(52) U.S. Cl.
CPC ..... *B65D 1/00* (2013.01); *B65D 1/26* (2013.01); *B65D 1/265* (2013.01); *B65D 1/42* (2013.01); *B65D 21/02* (2013.01); *B65D 21/0233* (2013.01)

(58) Field of Classification Search
USPC ..... 215/10; D7/530, 531
See application file for complete search history.

(56) References Cited

U.S. PATENT DOCUMENTS

| | | | | |
|---|---|---|---|---|
| 2,412,178 | A | 12/1946 | Seigh | |
| D177,630 | S | 5/1956 | Kohl | |
| 2,931,535 | A | 4/1960 | Lockwood | |
| 3,091,360 | A | 5/1963 | Edwards | |
| 3,094,240 | A | 6/1963 | Wanderer | |
| D196,271 | S | 9/1963 | Edwards | |
| D197,313 | S | 1/1964 | Wanderer | |
| 3,194,468 | A | 7/1965 | Baron | |
| D204,212 | S | 3/1966 | Davis | |
| 3,288,340 | A | 11/1966 | Shapiro et al. | |
| 3,437,253 | A | 4/1969 | Davis et al. | |
| 3,443,715 | A | 5/1969 | Bryant | |
| 3,443,716 | A | 5/1969 | Evans | |
| 3,483,908 | A | 12/1969 | Donovan | |
| 3,530,917 | A | 9/1970 | Donovan | |
| 3,581,930 | A | 6/1971 | Gunnink | |
| D223,999 | S | 6/1972 | Klose | |
| 3,934,725 | A | 1/1976 | Edwards | |
| D244,740 | S | 6/1977 | Durand | |
| 4,082,184 | A * | 4/1978 | Hammer | B65D 1/22 206/520 |
| D271,083 | S | 10/1983 | Tyler | |
| 4,446,969 | A | 5/1984 | Tyler | |
| 4,578,296 | A | 3/1986 | Miyazaki et al. | |
| D308,318 | S | 6/1990 | Durand | |
| 5,040,698 | A | 8/1991 | Ramsey et al. | |
| D321,652 | S | 11/1991 | Palisin, Jr. | |
| D322,032 | S | 12/1991 | Palisin, Jr. | |
| D322,033 | S | 12/1991 | Palisin, Jr. et al. | |
| 5,267,685 | A | 12/1993 | Sorensen | |
| 5,415,339 | A | 5/1995 | Howard | |
| D362,786 | S | 10/1995 | Andress et al. | |
| D381,558 | S | 7/1997 | Schaefer et al. | |
| D415,025 | S | 10/1999 | Mccann | |
| D428,307 | S | 7/2000 | Yeandel | |
| D438,466 | S | 3/2001 | Fletcher et al. | |
| D438,794 | S | 3/2001 | Miles et al. | |
| D448,243 | S | 9/2001 | Kehrein | |
| D510,679 | S | 10/2005 | Smith et al. | |
| D515,358 | S | 2/2006 | Orr et al. | |
| D529,340 | S | 10/2006 | Laib et al. | |
| D534,039 | S | 12/2006 | Laib et al. | |
| D570,681 | S | 6/2008 | Hussain et al. | |
| D574,192 | S | 8/2008 | Schösser | |
| D595,090 | S | 6/2009 | Benson | |
| 7,546,932 | B2 | 6/2009 | Stillerman et al. | |
| D608,591 | S | 1/2010 | Hillebrenner et al. | |
| 7,699,216 | B2 | 4/2010 | Smith et al. | |
| D618,962 | S | 7/2010 | Liming | |
| D627,636 | S | 11/2010 | Fang | |
| 8,025,210 | B2 | 9/2011 | Johnson et al. | |
| D649,034 | S | 11/2011 | Cimmerer et al. | |
| D675,519 | S * | 2/2013 | Knuston | D9/429 |
| D745,386 | S | 12/2015 | Covey et al. | |
| D801,807 | S | 11/2017 | Rapparini | |
| 10,974,861 | B2 * | 4/2021 | Liming | B65D 1/26 |
| 11,167,874 | B2 * | 11/2021 | Hodge | B65D 1/265 |
| 11,370,579 | B2 * | 6/2022 | Scott | B21D 51/26 |
| 11,794,940 | B2 * | 10/2023 | Liming | A45F 3/20 |
| 2003/0094393 | A1 | 5/2003 | Sahm, III | |
| 2006/0076395 | A1 | 4/2006 | Hayes et al. | |
| 2006/0226162 | A1 | 10/2006 | Hayes et al. | |
| 2007/0289892 | A1 | 12/2007 | Hogerty | |
| 2009/0020597 | A1 | 1/2009 | D'Amato | |
| 2009/0277812 | A1 | 11/2009 | Driscoll | |
| 2010/0072268 | A1 | 3/2010 | Johnson et al. | |
| 2011/0220665 | A1 | 9/2011 | McDonnell et al. | |
| 2012/0012647 | A1 | 1/2012 | Almabekov | |
| 2017/0042362 | A1 | 2/2017 | Bunner et al. | |

FOREIGN PATENT DOCUMENTS

| | | | | |
|---|---|---|---|---|
| DE | 1216139 | B | 5/1966 | |
| GB | 716006 | A | 9/1954 | |
| GB | 1096451 | A | 12/1967 | |
| GB | 1251595 | A | 10/1971 | |
| GB | 1558761 | A * | 1/1980 | B65D 1/265 |
| RU | 61521 | U1 | 2/2007 | |
| WO | 2006043971 | A1 | 4/2006 | |
| WO | 2006093952 | A1 | 9/2006 | |

* cited by examiner

CONTAINER HAVING A STACKING FEATURE

CROSS REFERENCE TO RELATED APPLICATIONS

This application is a continuation-in-part of and claims priority to U.S. application Ser. No. 17/508,825 entitled "Container Having Enhanced Wall Integrity and Alignment Element," filed on Oct. 22, 2021 and currently pending, which is a divisional of U.S. application Ser. No. 15/090,280 entitled "Container Having Enhanced Wall Integrity and Alignment Element," filed on Apr. 4, 2016 and now issued as U.S. Pat. No. 11,167,874, which is a continuation of U.S. application Ser. No. 13/162,307 entitled "Container Having Enhanced Wall Integrity and Alignment Element," filed on Jun. 16, 2011 and now issued as U.S. Pat. No. 9,314,089. This application also claims priority to U.S. Provisional Patent Application No. 63/248,929 entitled "Container Having Enhanced Wall Integrity, Alignment Element and Upper Stacking Feature," filed Sep. 27, 2021 and currently pending. The entire disclosures, including the specifications and drawings, of all above-referenced applications, as well as U.S. application Ser. No. 16/154,214, are incorporated herein by reference.

FIELD OF INVENTION

The present invention relates generally to containers, and more specifically, the invention relates to containers with stacking features to facilitate easy stacking with other containers of its kind.

BACKGROUND OF INVENTION

Thin-walled disposable plastic containers made by conventional thermoforming techniques have long been known in the art. Such containers, which are often used to hold food and beverage, are frequently used at parties, gatherings, and other occasions where little or no clean-up is desired. Although these thermoplastic containers offer consumers with many benefits, there are drawbacks affiliated with their manufacture and use. For example, because of their extremely thin walls, these containers are subject to bending, distortion, collapsing, and crushing when they are grasped by a user.

The art has turned to a number of devices and means for strengthening such containers. One solution has been to provide thicker material construction. However, this increases production costs. Another solution, as set forth in U.S. Pat. No. 6,554,154, has been to provide annular ribs in the container sidewall. However, the strength enhancement that may be achieved by using annular ribs is limited, especially in the middle regions of the sidewall, where gripping normally occurs.

Another drawback with such containers, particularly those containers having cross-sectional shapes that may, at least partially, be non-round, involves the containers not fully nesting one within the other when they are stacked. As is known in the art, containers are stacked one on top of the other during shipment, storage, and dispensing. When stacked, it is desirable that the containers be fully nested. If the containers are not fully nested, the stack of containers will take up more space than necessary and may become unstable. Additionally, it can result in multiple containers sticking together when a user intends to grab only one container from the stack.

Accordingly, a need exists for a disposable plastic container having a sidewall of increased strength, while avoiding the use of thicker material. A need also exists for a plastic container having features for ensuring the container becomes fully nested in a stack of containers.

SUMMARY OF INVENTION

The present invention is directed generally to a container with a stacking feature and one or more alignment structures. The container may include a bottom wall and a circumferential sidewall extending upwardly therefrom to form an open mouthed container with an upper rim. The container may include one or more axially-extending alignment structures circumferentially spaced around the sidewall and extending at least a portion of the height of the sidewall. The alignment structures may form a polygonal cross-sectional shape in at least a portion of the sidewall of the container and may be configured as rotational elements that urge rotation and alignment of the sidewalls of two containers when stacked together. The alignment structures of the container may be designed and configured in accordance with the teachings of U.S. Pat. No. 9,314,089, the entire disclosure of which is incorporated herein by reference.

According to one embodiment, the container may include an upper stacking shoulder formed into the sidewall of the container. The upper stacking shoulder may located below the upper rim of the sidewall and above the alignment structures. The upper stacking shoulder may extend radially outward and increase the diameter of the sidewall of the container. The upper stacking shoulder may include a radially extending lower portion extending outward from the sidewall and an upper portion extending generally vertically upward from the lower portion. The upper stacking shoulder may include a stacking corner formed at the intersection of the upper portion and the lower portion that can provide a ledge or seat of the stacking shoulder.

According to one embodiment, the container may include a lower stacking indent formed into the sidewall of the container. The lower stacking indent may be located above the bottom wall of the container and below the alignment structures. The lower stacking indent may extend radially inward and decrease the diameter of the sidewall of the container. The lower stacking indent may include an upper portion extending inward from the sidewall and a lower portion extending downward from the upper portion and toward the bottom wall. The lower stacking indent may form a ledge or seat at the intersection of the upper portion and the lower portion.

The upper stacking shoulder may have an exterior diameter measured along the exterior surface of the container at the stacking corner of the upper stacking shoulder. The exterior diameter of the upper stacking shoulder may constitute the outermost point of the stacking shoulder. The container have an interior diameter measured along the interior surface of the container sidewall at the inner most portion of the upper rim of the sidewall. The exterior diameter of the upper stacking shoulder may be configured to be greater than the interior diameter of the container stacked together, the upper stacking shoulder of the first container comes into contact with and seats upon the upper rim of the second container as the two containers are stacked one within the other. The configuration of the upper stacking shoulder may be configured to provide increased strength at an upper end of the container while also facilitating the nesting and un-nesting of two or more containers.

Other and further objects of the invention, together with the features of novelty appurtenant thereto, will appear in the course of the following description.

BRIEF DESCRIPTION OF DRAWINGS

In the accompanying drawings, which form a part of the specification and are to be read in conjunction therewith in which like reference numerals are used to indicate like or similar parts in the various views.

Figure 1:
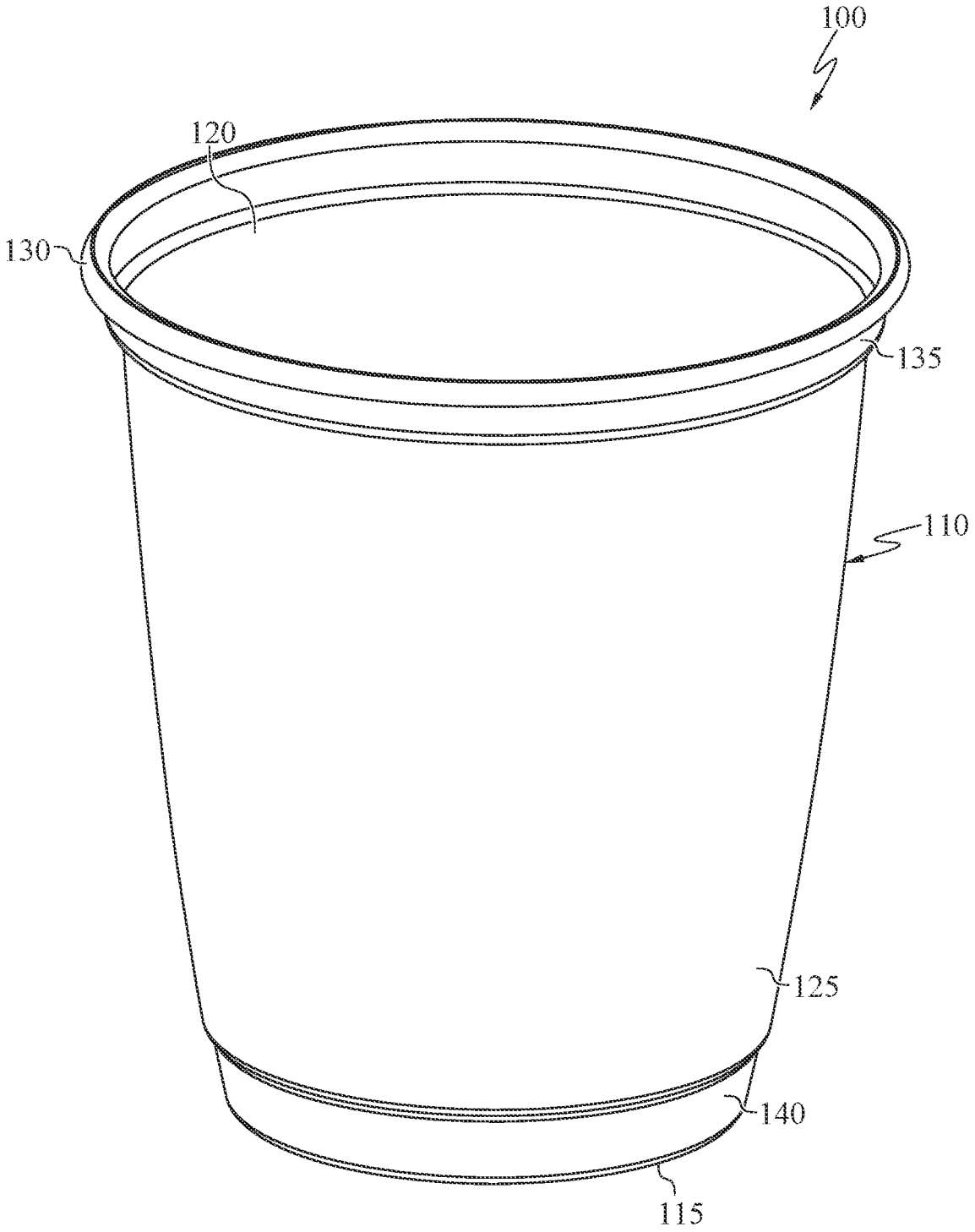
FIG. 1 is a side perspective view of a container with a stacking feature in accordance with one embodiment of the present invention.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The present invention is directed generally toward a container 100 with an upper stacking feature and/or a lower stacking feature as illustrated in the several figures. In certain embodiments, the container 100 may include both an upper stacking feature 135 and a lower stacking feature 140. In other embodiments, the container 100 may include an upper stacking feature 135 but does not include a lower stacking feature 140. In yet other embodiments, the container 100 may include only a lower stacking feature 140.

Figure 2:
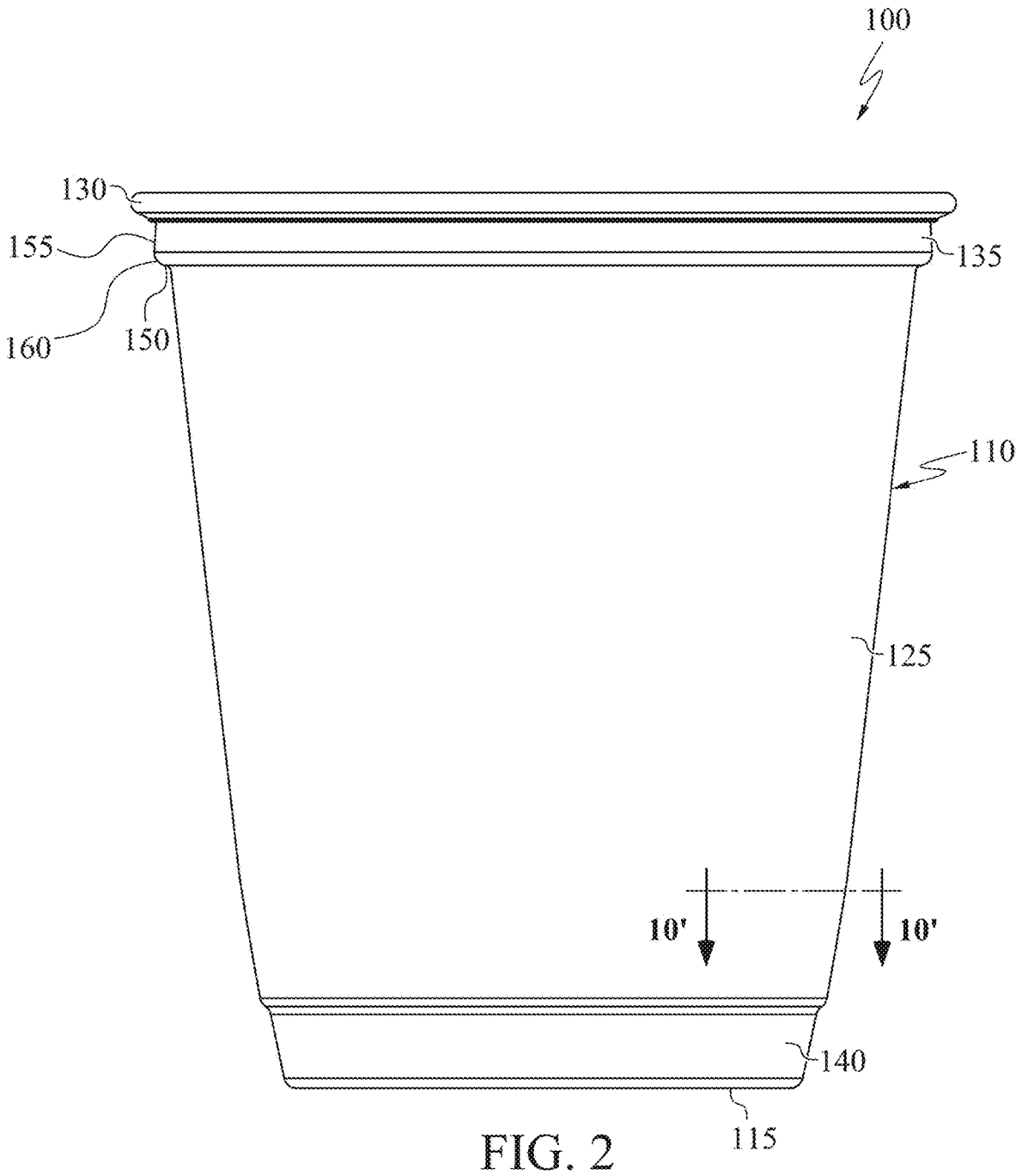
FIG. 2 is a side elevation view of the container of FIG. 1.
Figure 3:
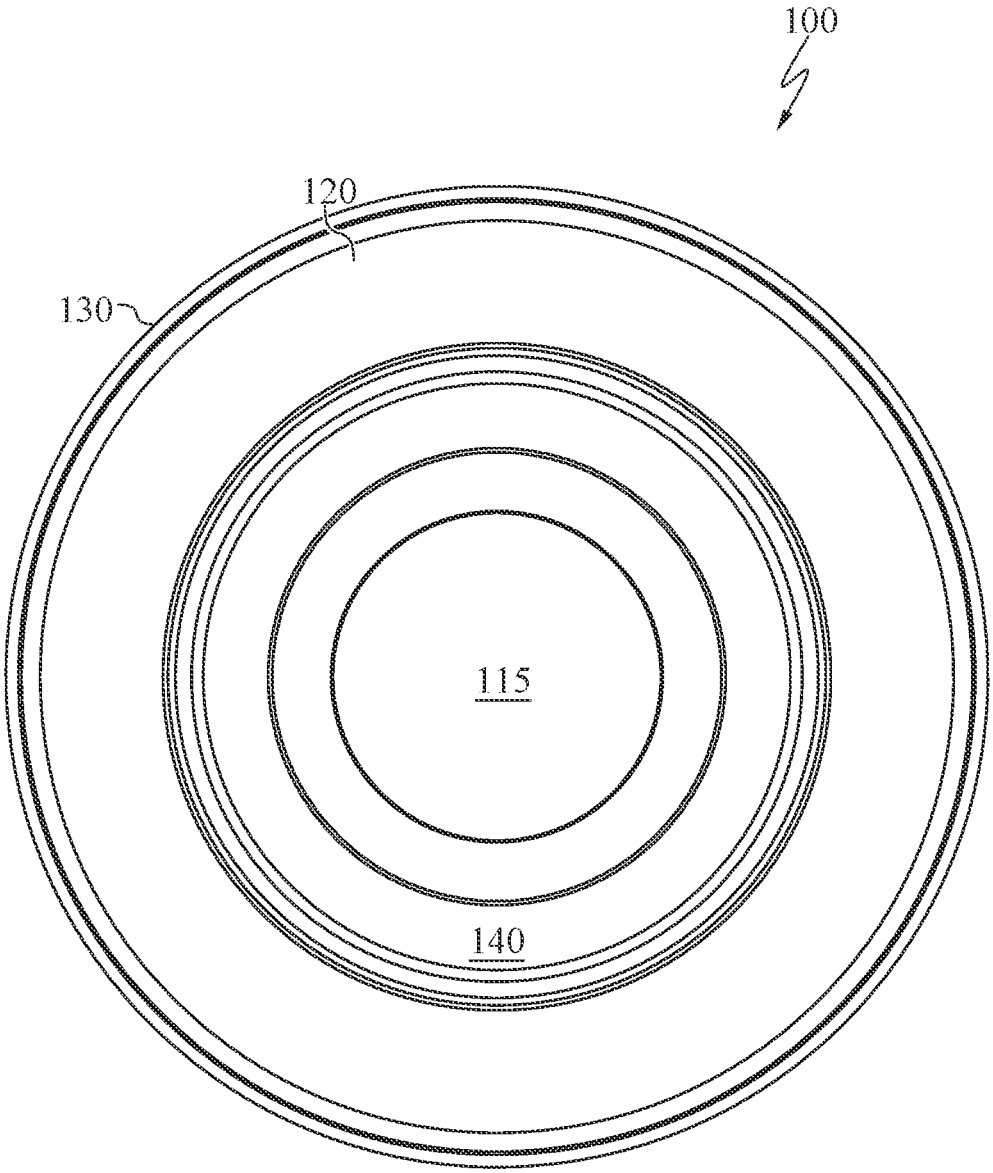
FIG. 3 is a top plan view of the container of FIG. 1.

The container 100 may be configured to be suitable for holding food and beverage products or any other goods or products that would typically be held within a container. According to certain embodiments, the container 100 may include a circumferential sidewall 110 extending upwardly from a bottom wall 115 as shown in FIGS. 1-3. As best illustrated in FIG. 2, the sidewall 110 may incorporate the upper stacking feature 135 and/or the lower stacking feature 140 within the sidewall 110 along its height. Alternatively, the upper and/or lower stacking features 135 and 140 may configured as the upper and lower end portions of the container 100 and the sidewall 100 may extend therebetween. The sidewall 110 may be generally frustoconical and, in some embodiments, may have a truncated barrel shape and/or have a slightly outwardly bowed profile. The sidewall 110 may include interior and exterior surfaces 120 and 125. As further shown in FIGS. 1-3, the container 100 may include an annular rim or lip 130 provided at the top end of the sidewall 110 to form a comfortable drinking surface for the mouth of a user, provide rigidity to the top of the container 100, and/or, optionally, for attachment of a lid (not shown) to the container 100. As illustrated in FIGS. 1-3, annular rim 130 may be configured as an outwardly-rolled rim; however, it is recognized annular rim may be configured any suitable container rim or lip configuration or design.

Figure 7:
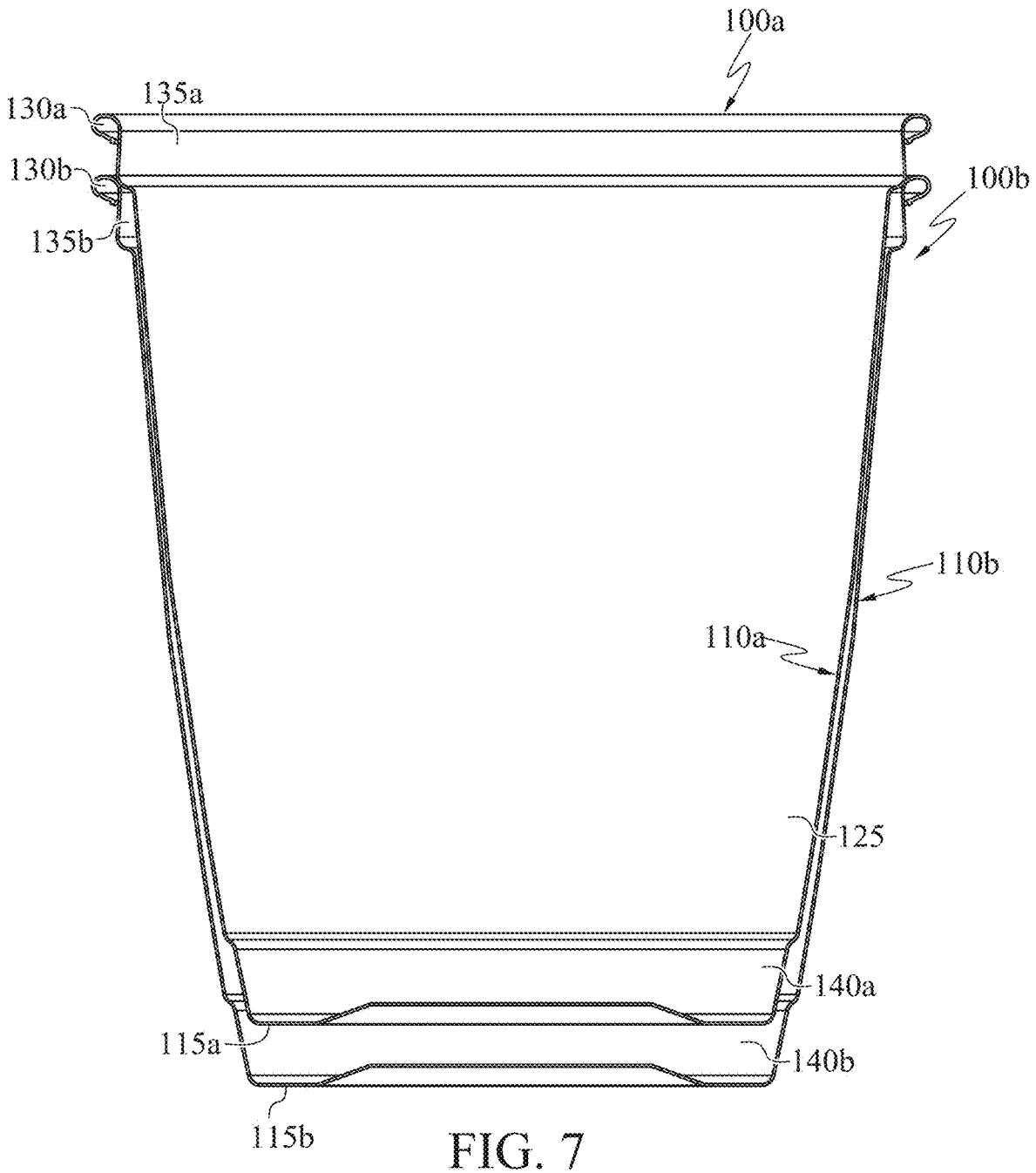
FIG. 7 is a front side sectional view of two nested containers in accordance with one embodiment of the present invention.
Figure 8:
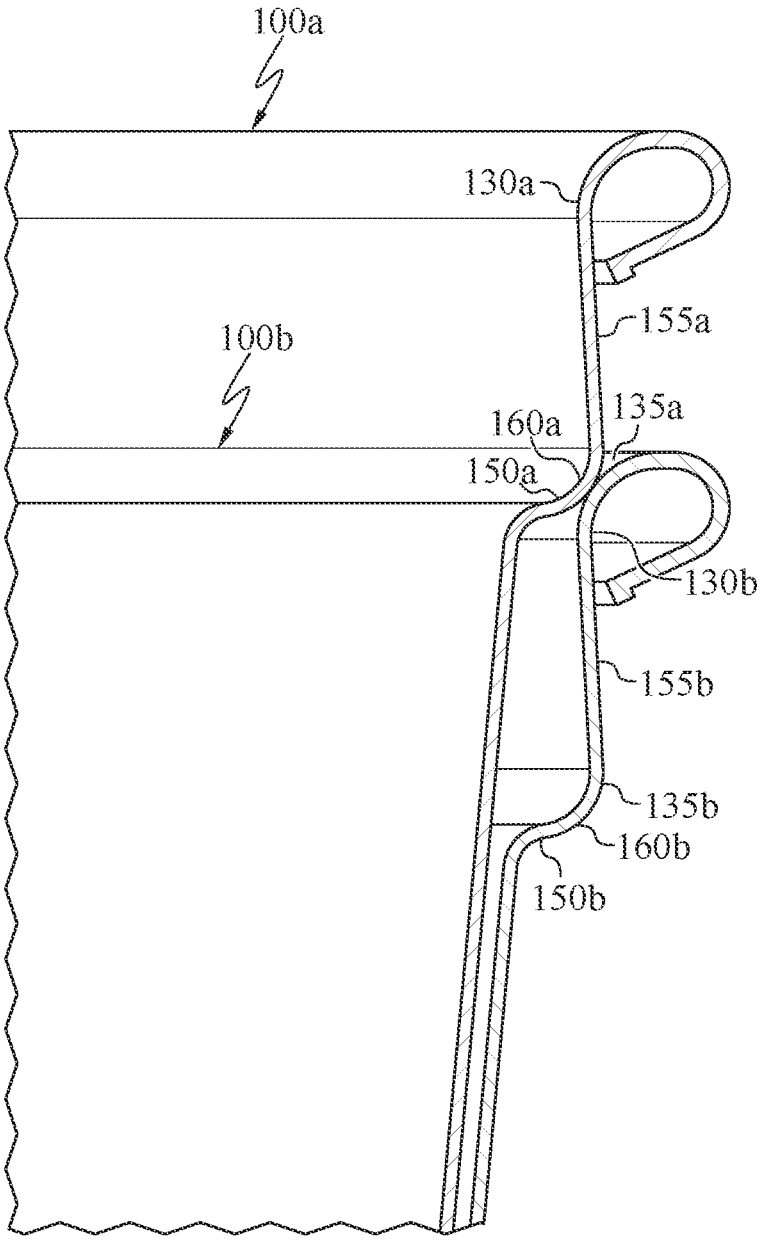
FIG. 8 is an enlarged partial front side sectional view of the containers of FIG. 7 illustrating an upper stacking shoulder of the inner container nested on an upper rim of the outer container in accordance with one embodiment of the present invention.
Figure 9:
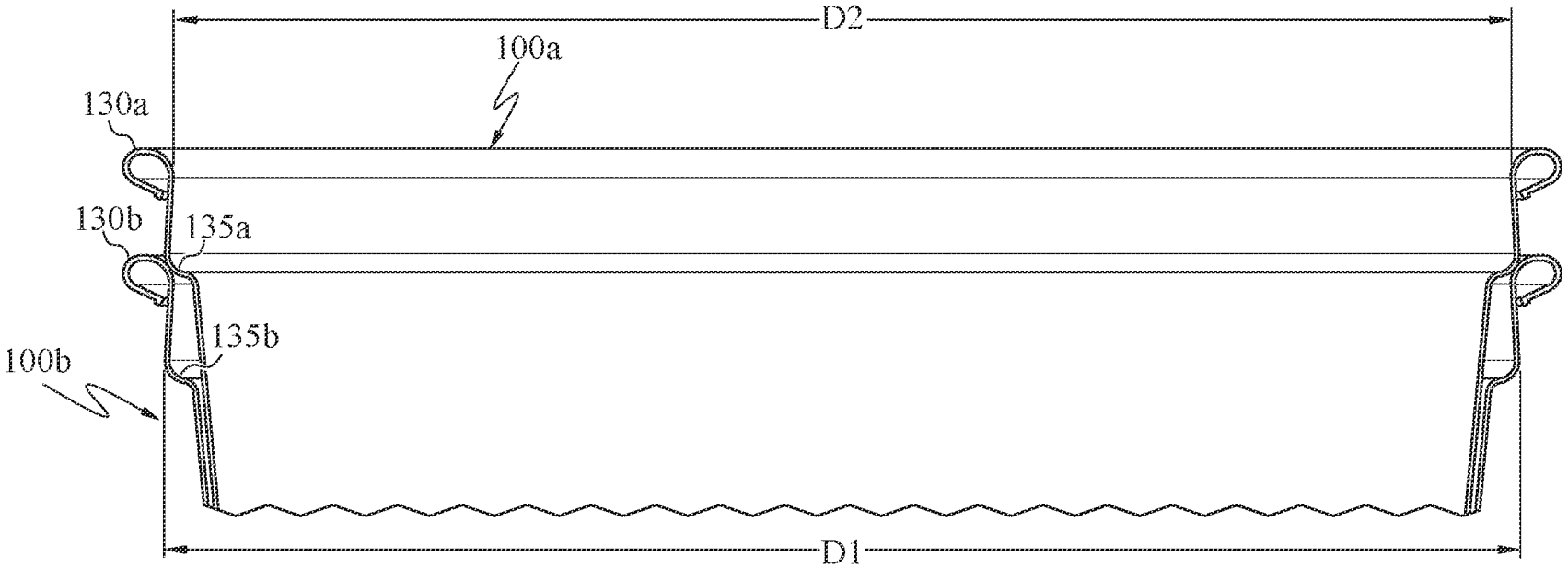
FIG. 9 is a partial front side sectional view of the containers of FIG. 7 illustrating the upper ends of the containers when nested together in accordance with one embodiment of the present invention.

The container 100 may be configured as an open-ended container any may be configured with any suitable size, shape, and configuration. In one embodiment, the container 100 has a frustoconical shape; that is, the container 100 has a generally circular cross-section decreasing in diameter as the sidewall 110 tapers from top to bottom such that the diameter at the upper end portion and top open mouth of the container 100 is generally larger than the diameter at the lower end portion and the bottom wall 115 of the container 100. The upwardly and outwardly taper of the container 100 provides a means for stacking a plurality of containers 100, as illustrated in FIGS. 7-9. It will be appreciated, however, by those skilled in the art that different shapes may serve equally as well and may be required by a desired application. The container 100 may be manufactured of a thin polymeric, non-polymeric, or plastic material and in manner utilizing a thermoforming process as is typically known in the art. As such, the container 100 can be made of materials such as polyethylene, polypropylene, polyester, polystyrene, or another suitable material now known or hereafter developed. It is also recognized that the container 100 of the present invention may be made using any suitable material or construction method.

Figure 4:
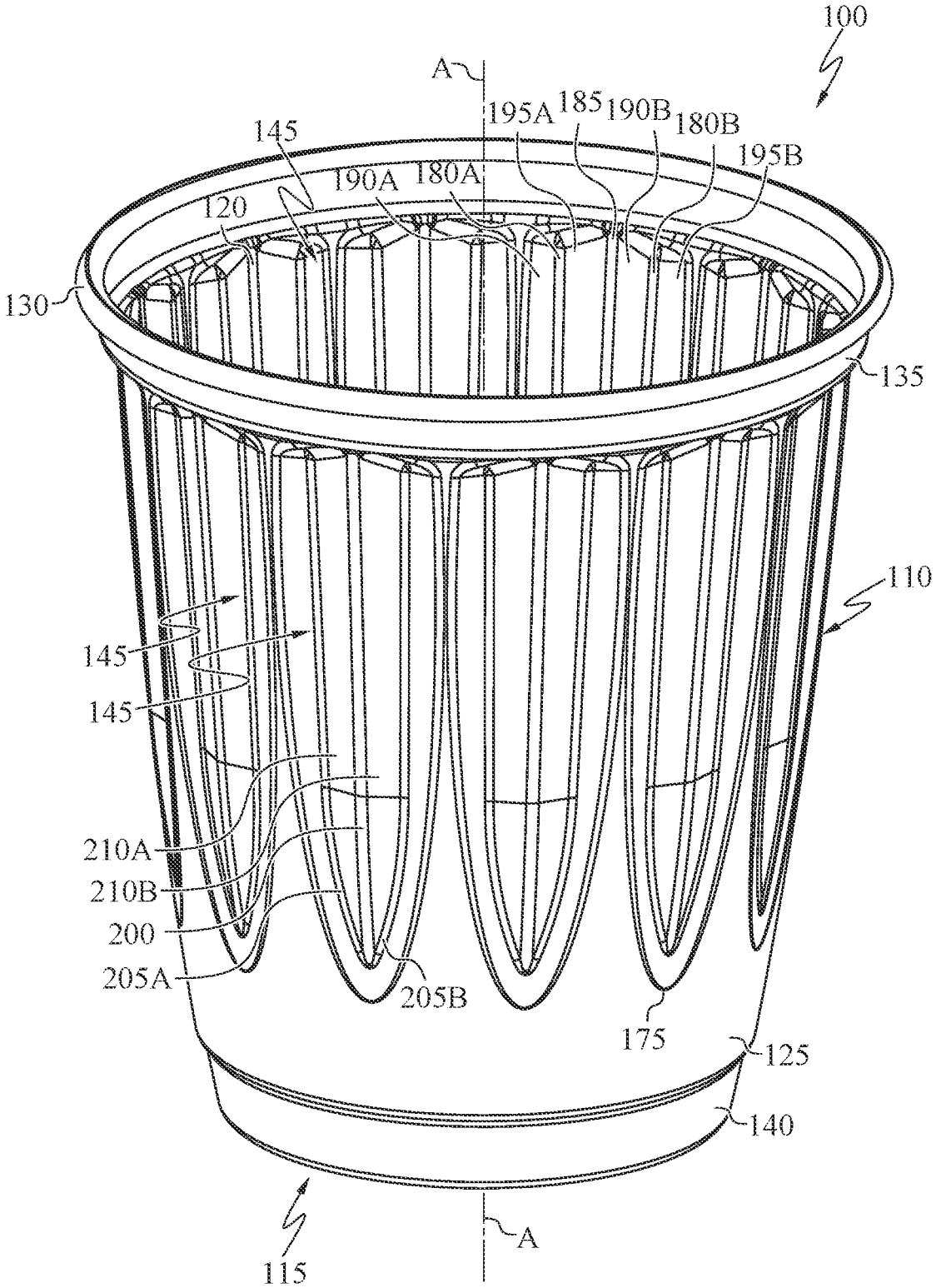
FIG. 4 is a side perspective view of a container with a stacking feature and an alignment structure in accordance with one embodiment of the present invention.
Figure 5:
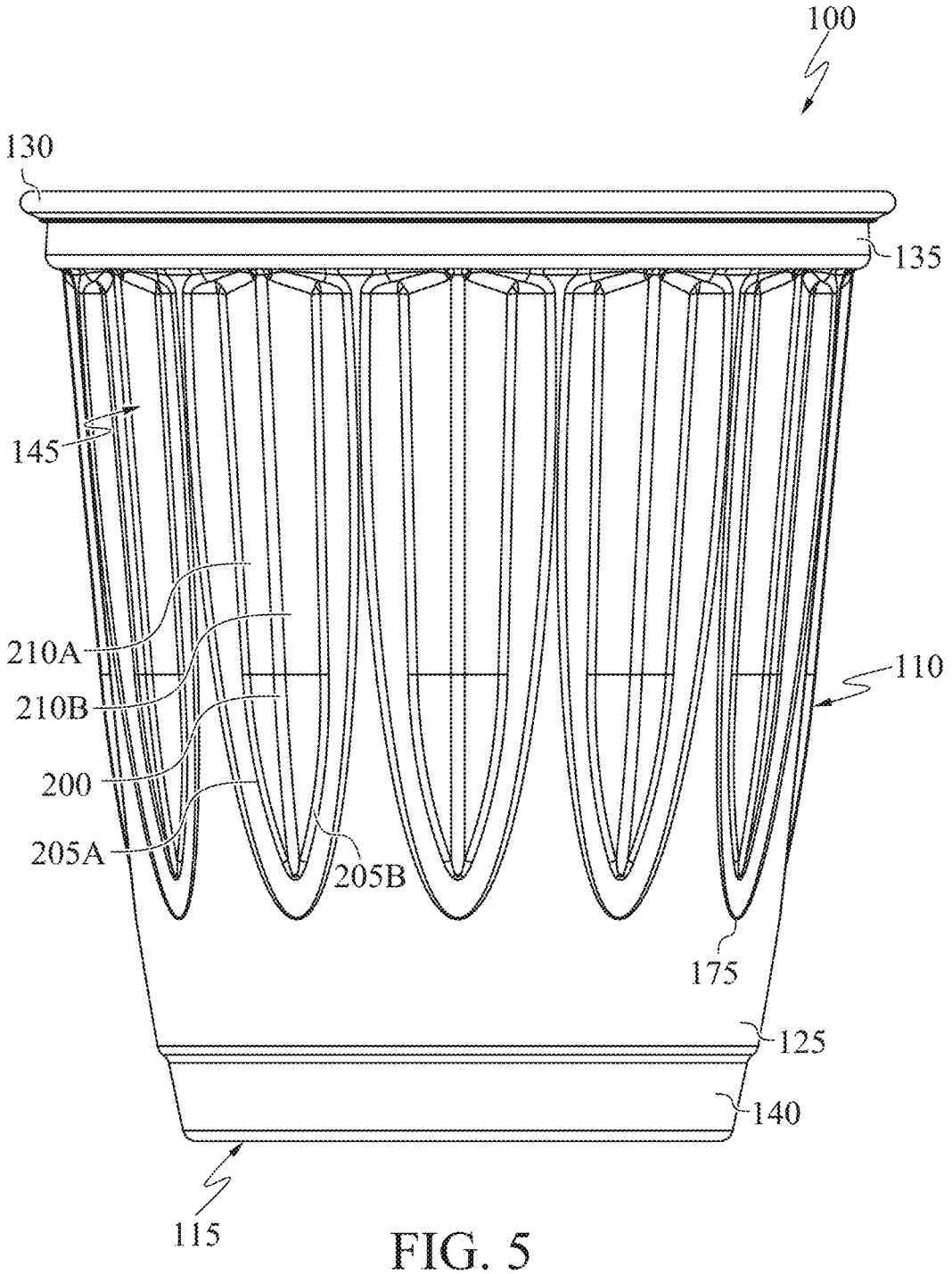
FIG. 5 is a side elevation view of the container of FIG. 4.
Figure 6:
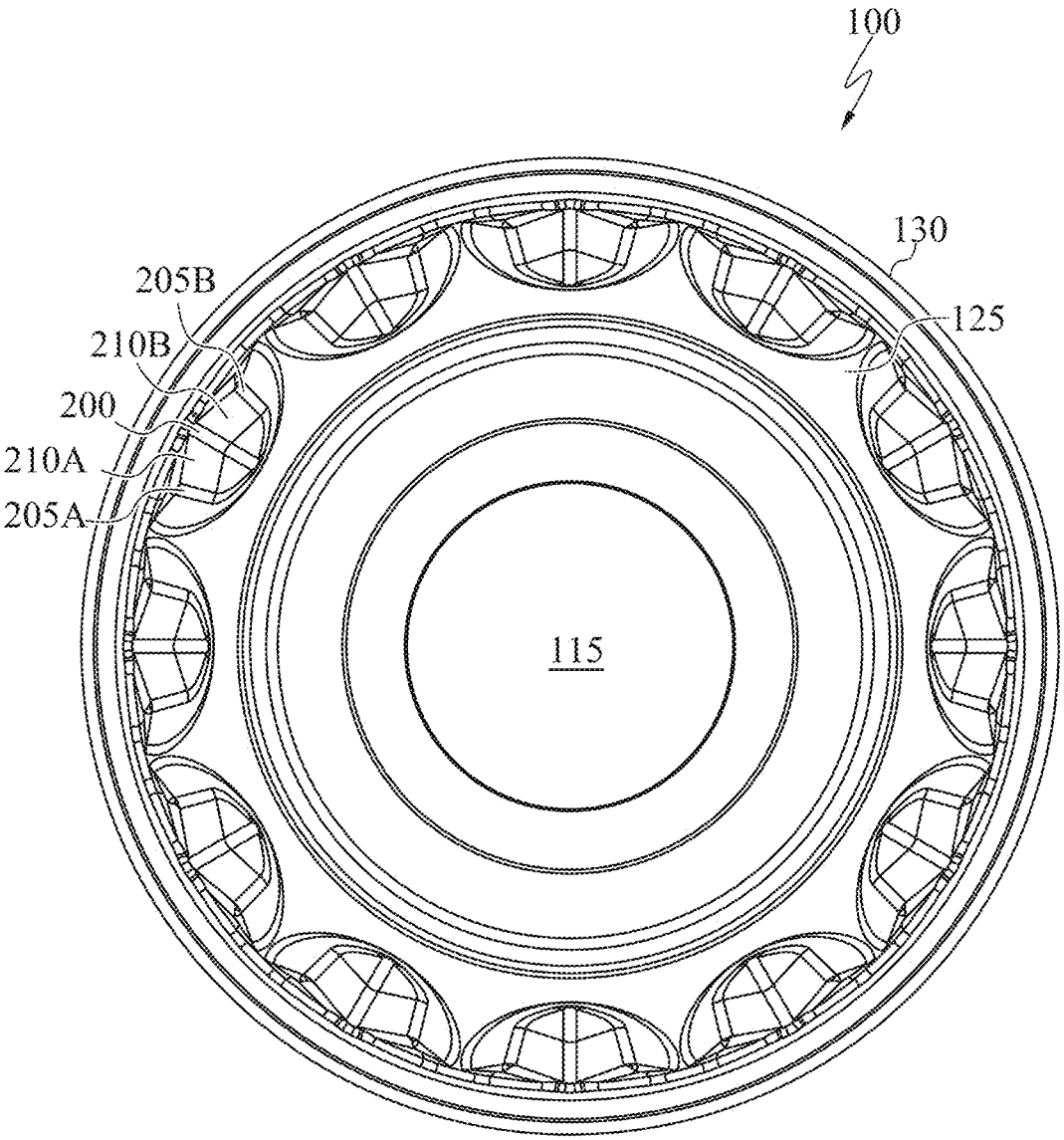
FIG. 6 is a bottom plan view of the container of FIG. 4.

In order to increase the structural rigidity and integrity of the sidewall 110, as compared to commonly-known round containers, the sidewall 110 of the container 100 may have a generally symmetrical polygonal cross-sectional shape at particular heights of the sidewall. In particular, the sidewall 110 may have a polygonal cross-sectional shape at a selected height or selected length of the height of the sidewall 110. According to certain embodiments, the polygonal cross-sectional shape of the sidewall 110 may be provided at the height of the sidewall that includes one or more alignment structures 145 as illustrated in FIGS. 4-6 and described in greater detail below. This sidewall structure may increase the strength and rigidity of the sidewall 110 and allow the sidewall 110 to be made with a reduced or thinner thickness, thereby potentially reducing the weight and cost of the container 100. It is also recognized that the polygonal cross-sectional shape of the sidewall 110 may take a variety of shapes, including but not limited to, octagonal, nonagonal, decagonal, hendecagonal, dodecagonal or any other suitable polygonal shape.

In certain embodiments where the container 100 includes one or more alignment structures as shown in FIGS. 4-6 and described in greater detail, the sidewall 110 of container 100 may have a generally circular cross-sectional shape with polygonal segments spaced along the diameter of the sidewall 110 as a result of the alignment structures 145 formed into the sidewall. Additionally, in certain embodiments, the sidewall 110 may have a generally circular cross-sectional shape except at regions where the alignment structures 145 are located, which may form a polygonal cross-sectional shape or partial polygonal cross-sectional shape. In such embodiments, the cross-sectional shape of the sidewall 110 is generally circular at locations above and below the alignment structures 145 along the height of the sidewall 110 and generally polygonal at locations with the alignment structures 145. It is also recognized that in certain embodiments (see FIGS. 1-3), the sidewall 110 may have a circular cross-sectional shape along the entire height of the sidewall 110.

As set forth above and shown in the figures, the container 100 may include a sidewall 110 with an upwardly and outwardly taper allowing a plurality of containers 100 to be stacked or nested together during shipping and storage. The sidewall 110 may be of any suitable size, shape, and configuration.

According to one embodiment as illustrated in FIGS. 4-6, the container 100 may include at least one generally axially-extending rotational element or alignment structure 145 formed or provided in sidewall 110. As shown, the container 100 illustrated in FIGS. 4-6 may be configured in the same manner as the container 100 illustrated in FIGS. 1-3 with the addition of the alignment structures 145 provided along a portion of the height of the sidewall 110. The one or more alignment structures 145 may be configured for urging misaligned containers 100 to become aligned when two containers 100 are stacked together. In doing so, the alignment structure 145 may be adapted to cause one container 100*a* to rotate and orient itself with respect to a second container 100*b* about a longitudinal axis A-A as the two containers 100*a* and 100*b* are being stacked. The alignment structures 145 of the container 100 may be designed and configured in accordance with the teachings of U.S. Pat. No. 9,314,089, which as set forth below, is incorporated herein by reference. In addition to or alternatively to alignment structures 145, the container 100 may include of one or more ribs, protrusions, indentions, or similar structures formed into the sidewall 110 to increase the structural strength and rigidity of the sidewall 110 but do not necessarily function to cause rotation or alignment of the container 100*a* with respect to a second container 100*b*.

When a plurality of containers 100 having polygonal sidewalls 110 are stacked one on top of the other, it is generally preferred that corresponding portions of the polygonal sidewalls 110 (including the respective alignment structures 145) of the containers 100, particularly the corresponding polygonal sidewall portions and alignment structures 145 of two adjacently-stacked containers 100, are aligned parallel with one another so that the containers 100 become fully nested one within the other. However, when such containers 100 (with polygonal cross-sectional shaped sidewalls 110) are stacked, it is common that two adjacently-stacked containers 100 will be oriented in a manner such that their corresponding polygonal sidewall portions and respective alignment structures 145 are not aligned parallel to each other. In such a case, the containers 100 cannot become fully nested. When this happens, the stack of containers 100 may be more susceptible to tipping and will take up more space than if all of the containers 100 were fully nested. Additionally, it can result in multiple containers sticking together during the manufacturing process or when a user intends to grab only one container from the stack. Thus, it is desirable for the respective alignment structures 145 of adjacently-stacked containers 100 to be aligned. The alignment structures 145 described herein, when incorporated into container 100, can facilitate the proper alignment of the polygonal sidewall portions of adjacently-stacked containers 100.

As shown in FIGS. 1-9, the container 100 may include an upper stepped portion or stacking shoulder 135 provided in sidewall 110 and adjacent to rim 130. The upper stacking shoulder 135 may be continuously extending or intermittently provided around the sidewall 110. According to certain embodiments, the upper stacking shoulder 135 may be configured as a complete annular shoulder configured into sidewall 110 so that it extends around the entirety of the sidewall 110. In other embodiments (not shown), the upper stacking shoulder 135 may be configured as a plurality of intermittently spaced shoulder segments formed at spaced intervals around the circumference of the sidewall 110. As best shown in FIGS. 1-2 and 4-5, the upper stacking shoulder 135 may be arranged and positioned in sidewall 110 just below upper rim 130. As best shown in FIGS. 4 and 5, in accordance with certain embodiments, the upper stacking shoulder 135 may be positioned just below upper rim 130 and above the alignment structures 145 and may extend outwardly relative to the remainder of the sidewall 110. According to one embodiment, the upper stacking shoulder 135 may be formed into sidewall 110 so that interior surface 120 of sidewall 110 generally corresponds and conforms to exterior surface 125 of the sidewall 110. In such an embodiment, upper stacking shoulder 135 may be indented into interior surface 120 and protrude from exterior surface 125.

Turning to FIG. 8, the arrangement and configuration of upper stacking shoulder 135 according to one embodiment of the invention will be described in greater detail. FIG. 8 illustrates two identical containers 100*a* and 100*b* stacked and nested together, with each container 100*a* and 100*b* including upper stacking shoulders 135*a* and 135*b*. In the following, it should be understood that a like-numbered elements of the stacking shoulders 135*a* and 135*b* are labeled as either (a) or (b) in the figures, to indicate the corresponding container 100*a* or 100*b* they pertain to.

As best shown in FIGS. 2 and 8, the upper stacking shoulder 135 may include a generally radially extending wall portion 150, a generally upwardly extending wall portion 155, and an intersecting region or stacking corner 160 positioned between radially extending wall portion 150 and upwardly extending wall portion 155. As shown in FIG. 8, radially extending wall portion 150*a*, generally upwardly extending wall portion 155*a*, and stacking corner 160*a* correspond to container 100*a*, and radially extending wall portion 150*b*, generally upwardly extending wall portion 155*b*, and stacking corner 160*b* correspond to container 100*b*. As best shown in FIG. 8, the radially extending wall portion 150 may be formed into sidewall 110 (or connected to sidewall 110) and extend radially outward from the portion of sidewall 110 directly below upper stacking shoulder 135. The radially extending wall portion 150 may extend from sidewall 110 generally horizontally and/or with a slight inclined or upward angle. According to certain embodiments, the radially extending wall portion 150 may have an angle of inclination approximately between 0-45 degrees from horizontal; however, radially extending wall portion 150 may also have an inclination angle greater than 45 degrees in alternative embodiments. The radially extending wall portion 150 may have a curved, arcuate, and/or angled shape so that the angle of inclination varies along different points of the length of the radially extending wall portion 150. The configuration and shape of the radially extending wall portion 150 may form a seat or ledge within the stacking shoulder 135 and sidewall 110 for facilitating the stacking of multiple containers (i.e., 100*a* and 100*b*) as described below. The radially extending wall portion 150 may alternatively or additionally extend from sidewall 110 with a slight declined or downward angle in other embodiments of the invention.

As further shown in FIG. 8, the upwardly extending wall portion 155 may extend upward from the radially extending wall portion 150 (and the stacking corner 160 formed therebetween as described below) and toward the upper rim 130 that forms the upper end of sidewall 110 and the container 100. The upwardly extending wall portion 155 may extend from the radially extending wall portion 150 generally vertically and/or slightly inclined angle. As shown in FIG. 8, the upwardly extending wall portion 155 may extend upward with a slight inward angle toward the center of container 100 to provide a slight narrowing taper of upwardly extending wall portion 150 (relative to the remainder of sidewall 110). Thus, the diameter of upwardly extending wall portion 155 may gradually decrease in the direction of upper rim 130 of containers 100.

As also shown in FIG. 8, the stacking corner 160 may be provided between the radially extending wall portion 150 and upwardly extending wall portion 155 at the intersection where the radially extending wall portion 150 and upwardly extending wall portion 155 converge. As shown in FIG. 8, the stacking corner 160 may have a rounded or curved shape. In alternative embodiments (not shown), the stacking corner 160 may have an angled, squared, or other suitable shape. Collectively, the radially extending wall portion 150 and stacking corner 160 may provide a seat or ledge portion within the stacking shoulder 135 that may be configured to engage and be retained on the upper rim 130 of another container during stacking as illustrated in FIGS. 8 and 9.

As best shown in FIG. 9, upper stacking shoulder 135 may have an exterior diameter D1 measured at the outer-most portion of the upwardly extending wall portion 150 and stacking corner 160. The diameter D1 represents the outer-most diameter of upper stacking shoulder 135, which also represents the diameter of the exterior surface 125 of sidewall 110 at the point where stacking corner 160 transitions to or intersects with upwardly extending wall portion 150. As also shown in FIG. 9, container 100 at upper rim 130, may have an interior diameter D2 measured at the inner-most portion of rim 130. The diameter D2 represents the interior diameter approximately at the transition or intersection of the interior surface 135 of sidewall 110 and the upper rim 130 of container 100.

As shown in FIG. 9, the exterior diameter D1 at upper stacking shoulder 135 may be configured to be at least slightly greater than the interior diameter D2 at upper rim 130 so that the stacking corner 160 of upper stacking shoulder 135 is restricted by upper rim 130 and as a result seats on the interior surface 120 of upper rim 130 when multiple containers 100 are stacked and nested together. As shown in FIG. 9, when two containers 100*a* and 100*b* are stacked and nested together, the stacking shoulder 135*a* of the first (inner) container 100*a* engages and is restricted by the interior surface 120*b* of the upper rim 130*b* of the second (outer) container 100*b*, as described in greater detail below.

As shown in FIGS. 1-6 and 10, container 100 may include a lower stacking feature or indent 140 provided in sidewall 110 and adjacent to bottom wall 115. As best shown in FIGS. 1 and 2, the lower stacking indent 140 may be positioned within sidewall 110 just above bottom wall 115 and may extend inwardly relative to the remainder of the sidewall 110. In addition, as shown in FIGS. 4 and 5, in embodiments where container 100 includes alignment structures 145, the lower stacking indent 140 may be positioned just above bottom wall 115 and below the alignment structures 145 and may extend inwardly relative to the remainder of the sidewall 110.

Figure 10:
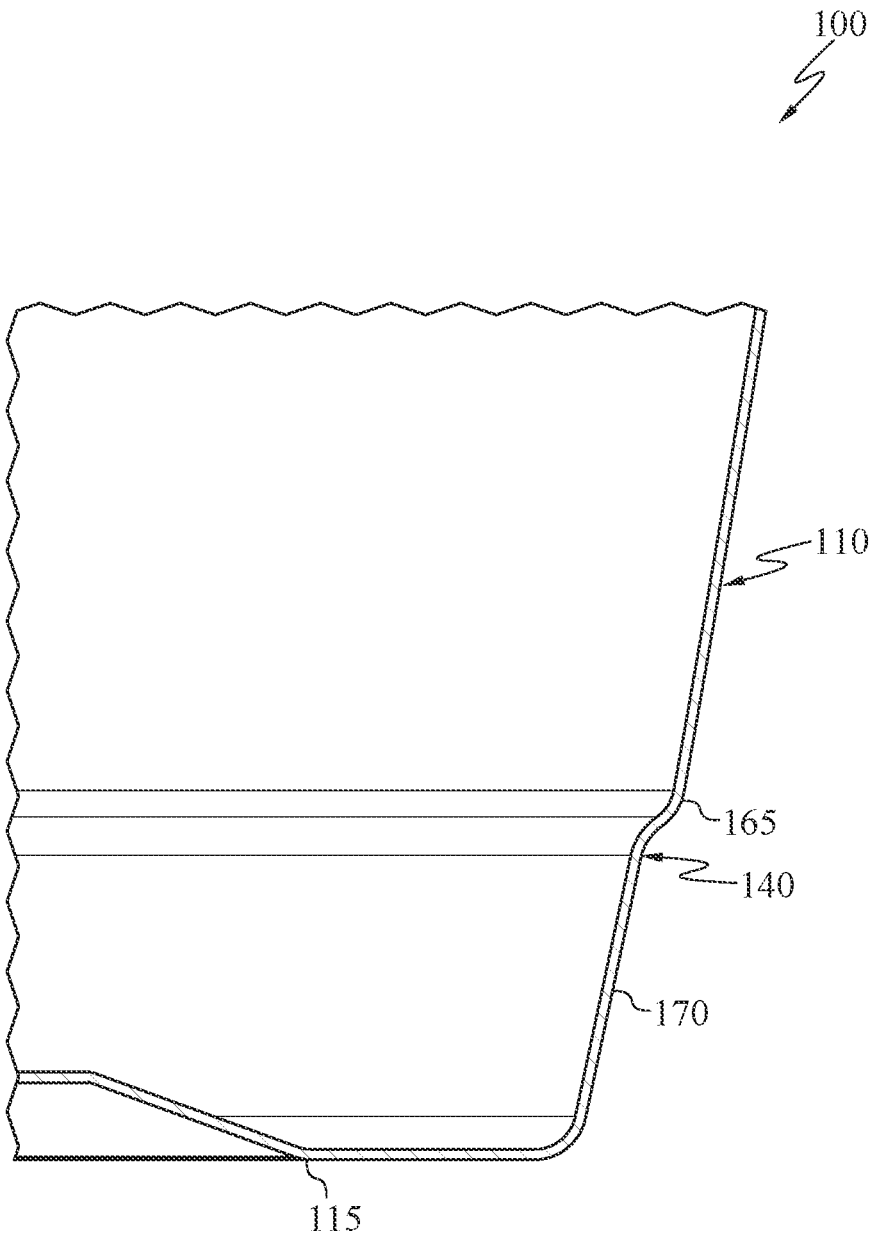
FIG. 10 is an enlarged partial front side sectional view of the container of FIG. 1 taken along line 10'-10' in FIG. 2, illustrating a lower stacking indent in accordance with one embodiment of the present invention.

As best shown in FIG. 10, the lower stacking indent 140 may include an upper portion 165 extending inward from the sidewall 110 generally horizontally or at a slight angle, and a lower portion 170 extending generally vertically or with a slight tapered angle toward the bottom wall 115. According to one embodiment as shown in FIG. 10, upper portion 165 may extend radially inward from the portion of sidewall 110 located above lower stacking indent 140. The radially inward configuration of the upper portion 165 may result in an increased reduction in diameter of sidewall 110 at lower stacking indent 140. As further shown in FIG. 10, according to one embodiment, upper portion 165 of lower stacking indent 140 may extend radially inward at a downward angle; however, it is recognized that upper portion 165 may alternatively extend generally horizontally inward to the interior of container 100 or at an inclined angle in alternative embodiments of the invention.

As further shown in FIG. 10, the lower portion 170 of lower stacking indent 140 may extend from upper portion 165 toward bottom wall 115 with a slight downward angle to provide a taper approximate the remainder of sidewall 110 above. Lower portion 170 may alternatively extend toward bottom wall 115 at an angle greater than or less than the taper of the remaining sidewall 110 in other embodiments of the invention. The configuration of the lower stacking indent 140 may form an indentation or ledge within the lower portion of the sidewall 110 to facilitate the stacking and nesting of multiple containers 100 as described in greater detail below.

Upper stacking shoulder 135 and lower stacking indent 140 may be individually and/or collectively configured to increase the strength and rigidity of the sidewall 110, while also allowing the sidewall 110 to have a reduced thickness, thereby potentially reducing the weight and material cost of container 100. In particular, the upper stacking shoulder 135 may provide increased circumferential or hoop strength at an upper end of the container 100. Upper stacking shoulder 135 and lower stacking indent 140 also help provide support to alignment structures 145 for additional sidewall 110 integrity.

As best shown in FIGS. 7-9, in addition to providing structural rigidity and strength to the sidewall 110 and container 100 overall, the upper stacking shoulder 135 and lower stacking indent 140 may facilitate efficient stacking and nesting of multiple containers 100. As shown in FIGS. 7-9, when one container 100*a* is stacked within a second container 100*b*, the upper stacking shoulder 135*a* of container 100*a* comes into contact with and seats upon the upper rim 130*b* of container 100*b*. As shown, the radially extending wall portion 150*a* and stacking corner 160*a* of upper stacking shoulder 135*a* extend radially outward from sidewall 110*a* and beyond the portion of sidewall 110*a* below upper stacking shoulder 135*a* to provide the upper stacking shoulder 135*a* with exterior diameter D1 as described previously. As illustrated in FIG. 9, exterior diameter D1 of upper stacking shoulder 135*a* of container 100*a* is greater than the interior diameter D2 of upper rim 130*b* of container

100*b*. The larger diameter D1 of upper stacking shoulder 135 allows upper stacking shoulder 135 of container 100*a* at stacking corner 160*a* to engage and be retained by of upper rim 130*b* of container 100*b* when two containers 100*a* and 100*b* are stacked together. The configuration of upper stacking shoulder 135*a* and resulting diameters D1 and D2 of container 100*a* results in the container 100*a* becoming nested within container 705*b* so that a gap or space along the height of sidewall 110*a* is provided at the upper and lower ends of the containers 100*b* and 100*a* as best illustrated in FIG. 7.

In particular, as shown in FIGS. 7-9, upper stacking shoulder 135 may be configured to enable full nesting of two stacked containers 100*a* and 100*b* while restricting the first (inner) container 100*a* from being overly nested within the second (outer) container 100*b*. The diameter D1 at the outer radial edge of upper stacking feature 135 (located at the outer most point of stacking corner 160) is slightly greater than the inner diameter D2 of container 100 located at the upper edge of the container 100 where sidewall 110 forms the upper rim 130. As such, when the first container 100*a* is inserted into and stacked with the second container 100*b*, the stacking shoulder 135 of container 100*a* engages and seats on the inner surface of outer rim 140 of container 100*b*, which provides a space or gap between the upper rims 130*a* and 130*b* of the two containers 100*a* and 100*b*. This may prevent over nesting of the two containers 100*a* and 100*b* and allow for easier separation of the containers 100*a* and 100*b* when de-nested or pulled apart for use. For purposes of foregoing description, "full nesting" of two containers 100*a* and 100*b* refers to the state where the first container 100*a* is fully inserted and nested into the interior of second container 100*b* and the stacking shoulder 135 of container 100*a* engages the inner surface of the container 100*b*.

Optionally, depending upon the embodiment, when container 100*a* is inserted and stacked into container 100*b*, the bottom wall 115*a* of container 100*a* may also contact and be seated on the lower stacking indent 140*b* of container 100*b*. As shown in FIG. 7, container 100*a* includes a bottom wall 115*a* and a lower stacking indent 140*a*, and container 100*b* includes a bottom wall 115*b* and a lower stacking indent 140*b*. As further shown in FIG. 10, the inward extension and configuration of the lower stacking indent 140*b* formed into the sidewall 110*b* of container 100*b* provides a reduced diameter of the sidewall 110*b* at the lower stacking indent 140*b* and, in some embodiments, enables the bottom wall 115*a* of container 100*a* to contact and be seated on the lower stacking indent 140*b* of container 100*b*. The resulting configuration allows the container 100*a* to be effectively nested within the container 100*b*.

While not specifically described above, it will be appreciated that the upper stacking feature 135 and/or lower stacking feature 140 described herein may be applied to or incorporated in various embodiments of containers, including but not limited to those embodiments disclosed in U.S. patent application Ser. No. 13/1815,307 filed on Jun. 16, 2011, to Don Hodge et al., entitled "Container Having Enhanced Wall Integrity and Alignment Element," which issued as U.S. Pat. No. 9,115,089, the entire disclosure, including the specification and drawings, of which is incorporated herein by reference.

According to certain embodiments of container 100, the alignment structures 145, which may be incorporated into container 100 along with one or both of upper and lower stacking features 135 and 140, may be designed or configured as any suitable type of structure or rotational element formed into the sidewall 110 of the container 100. As illustrated in FIGS. 4-6, according to one embodiment, the alignment structures 145 of container 100 are at least partially recessed within the sidewall 110. In other words, the alignment structures 145 are indented into the exterior surface 125 of the sidewall 110 and, thus, correspondingly protrude inwardly from the inner surface 120 of the sidewall 110 into the interior of the container 100. The alignment structures 145 can each be shaped to include a boundary edge 175, which may protrude outwardly from the exterior surface 125 of the sidewall 110 and form a v-shaped lower edge 170. As shown in FIGS. 4 and 6, because the alignment structure 145 is recessed into the sidewall 110, a resulting alternating series of generally radially intermittent, circumferentially-spaced peaks 180A, 180B and valleys 185 are formed into the interior surface 120 of the sidewall 110. Each interior peak 180A, 180B is divided to include first and second faces 190A, 190B and 195A, 195B sloping in opposite directions. Due to its formation into the sidewall 110, the alignment structure 145 also results in an alternating series of generally circumferentially-spaced peaks 200 and valleys 205A, 205B formed into the exterior surface 125 of the sidewall 110. Each exterior peak 200 is divided to include first and second faces 210A and 210B sloping in opposite directions.

While not specifically described or shown herein, it is also recognized that alignment structures 145 may have any number of different suitable designs and configurations that function as structural and/or rotational alignment features within the sidewall 110 of the container 100. For example, alignment structures 145 may be configured to project or protrude outwardly from the sidewall 110, project or protrude inwardly from the sidewall 110, or a combination thereof.

The alignment structure 145 urges one container 100*a* (or container 100*b*, as the case may be) to rotate with respect to an adjacently stacked container 100*b* (or container 100*a*, as the case may be). It should be understood that the containers 100 may be stacked in an upright orientation, such that one container 100*b* is placed within another container 100*a*, or stacked in an upside-down orientation, such that one container 100*a* is placed over another container 100*b*. The alignment structures 145 are designed to cause rotational movement of one container 100 with respect to another container 100 until and to the point where the respective alignment structures 145 of the containers 100 are generally aligned parallel with one another. As one container 100*b* is inserted into another container 100*a*, the corners (or of the first container 100*b* engage the interior peaks 180A, 180B of the second container 100*a*. As described above, the peaks 180A, 180B each have first and second faces 190A, 190B and 195A, 190B meeting at an apex and sloping away from one another. The apex of each peak 180A, 180B splits the peak 180A, 180B and causes the corner (or a protruding rib) of the other container to engage either the first face 190A, 190B or second face 195A, 195B of the peak 180A, 180B.

When the respective alignment structures 145 of the containers 100*a* and 100*b* are aligned parallel with one another, the container 100*a* may be inserted into the container 100*b* (or the container 100*b* may be inserted into the container 100*a*, as the case may be). Once the containers 100*a* and 100*b* are aligned with one another, the containers 100*a* and 100*b* may become fully nested. The containers 100*a* and 100*b* are considered fully nested when the upper stacking shoulder 135 of one container 100*b* comes into contact with the rim 130 of another container 100*a*. In addition, according to certain embodiments, the containers are considered fully nested when the bottom wall 115 of one container 100*b* comes into contact with lower stacking indent 140 of another container 100*a*.

The alignment structure 145 may have a parabolic-like shape, as shown in FIG. 4, a curvilinear shape or any other shape suitable for achieving the alignment outcome described herein. The alignment structure 145 may be either recessed into the sidewall 110, protruding outwardly from the sidewall 110, or both recessed into and protruding outwardly from the sidewall 110. In one embodiment, the container 100 includes some alignment structures 145 which are recessed into the sidewall 110 and some alignment structures 145 that are protruding therefrom. The alignment structure 145 can increase the structural rigidity and integrity of the sidewall 110 and can provide the sidewall 110 with contoured edges which aid a user in gripping the container 100.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A container comprising:

a bottom wall;

a frustoconical sidewall, the sidewall including a plurality of axially-extending alignment structures circumferentially spaced around the sidewall and extending at least a portion of a height of the sidewall, wherein each axially-extending alignment structure of the plurality of axially-extending alignment structures comprises first and second oppositely-sloping faces such that a longitudinally-extending apex is created within each axially-extending alignment structure;

an exterior surface of the sidewall;

an interior surface of the sidewall, the interior surface radially and axially conforming to the exterior surface of the sidewall;

an upper rim positioned at a top end of the sidewall;

an upper stacking shoulder positioned below the upper rim and above the axially-extending alignment structures; and a lower stacking indent positioned above the bottom wall and below the axially-extending alignment structures;

wherein each axially-extending alignment structure of the plurality of axially-extending alignment structures is recessed into the sidewall with an indented boundary edge extending around the first and second oppositely-sloping faces;

wherein the boundary edge of each axially-extending alignment structure of the plurality of axially-extending alignment structures forms into the sidewall a v-shaped lower edge of each axially-extending alignment structure; and wherein the v-shaped lower edge of each axially-extending alignment structure of the plurality of axially-extending alignment structures is spaced upwardly from the lower stacking indent.

2. The container of claim 1, wherein the upper stacking shoulder extends entirely around a circumference of the container.

3. The container of claim 1, wherein the upper stacking shoulder extends radially outward from the sidewall.

4. The container of claim 1, wherein the upper stacking shoulder includes a radially extending lower portion extending outward from the sidewall, and an upper portion extending upward from the lower portion.

5. The container of claim 4, wherein the radially extending lower portion extends outward horizontally and the upper portion extends vertically.

6. The container of claim 4, wherein the radially extending lower portion extends outward at an upward angle between 0 and 45 degrees from horizontal.

7. The container of claim 1, wherein the upper stacking shoulder forms a ledge within the sidewall, the ledge increasing a diameter of the sidewall at the upper stacking shoulder.

8. The container of claim 7, wherein the upper stacking shoulder includes a radially extending lower portion extending outward from the sidewall, and an upper portion extending upward from the lower portion, wherein the ledge includes a stacking corner located at an intersection of the radially extending lower portion and the upper portion of the upper stacking shoulder.

9. The container of claim 1, wherein the lower stacking indent extends radially inward from the sidewall.

10. The container of claim 1, wherein the lower stacking indent includes an upper portion extending inward from the sidewall, and a lower portion extending downward from the upper portion and toward the bottom wall.

11. The container of claim 10, wherein the upper portion extends inward-horizontally and the lower portion extends downward vertically.

12. The container of claim 11, wherein the lower portion extends downward at an inward angle.

13. The container of claim 1 wherein the lower stacking indent forms a seat within the sidewall, the seat reducing the diameter of the sidewall at the lower stacking indent.

14. The container of claim 1, wherein the container is capable of being fully nested within a second identical container.

15. The container of claim 14 wherein the axially-extending alignment structures are adapted for causing rotational movement of the container with respect to the second container about a longitudinal axis as the two containers are stacked one within the other.

16. The container of claim 14, wherein the upper stacking shoulder of the container is adapted to contact and seat upon the upper rim of the second container as the two containers are stacked one within the other.

17. The container of claim 14, wherein an exterior diameter of the upper stacking shoulder measured at the exterior surface of the sidewall is greater than an interior diameter of the upper rim measured at the interior surface of the sidewall.

18. A container comprising:

a bottom wall;

a frustoconical sidewall, the sidewall including at least one alignment structure formed into the sidewall and extending at least a portion of a height of the sidewall, wherein the at least one alignment structure is configured to provide structural rigidity to the sidewall;

an exterior surface of the sidewall;

an interior surface of the sidewall, the interior surface radially and axially conforming to the exterior surface of the sidewall;

an upper rim positioned at a top end of the sidewall;

an upper stacking shoulder positioned below the upper rim and above the at least one alignment structure; and a lower stacking indent positioned above the bottom wall and below the at least one alignment structure;

wherein the at least one alignment structure comprises first and second oppositely-sloping faces intersecting along a longitudinally-extending apex;

wherein the at least one alignment structure is recessed into the sidewall with an indented boundary edge extending around the first and second oppositely-sloping faces;

wherein the boundary edge of the at least one alignment structure forms into the sidewall a v-shaped lower edge of the at least one alignment structure;

wherein the v-shaped lower edge of the at least one alignment structure is spaced upwardly from the lower stacking indent.

* * * * *